United States Patent [19]

Marcucci

[11] Patent Number: 4,957,057

[45] Date of Patent: Sep. 18, 1990

[54] JOGGER'S NIGHTSTICK

[76] Inventor: Albert Marcucci, 1493 Kenmuir Avenue, Mississauga, Ontario, Canada, L5G 4B6

[21] Appl. No.: 292,072

[22] Filed: Dec. 30, 1988

Related U.S. Application Data

[63] Continuation-in-part of Ser. No. 911,600, Sep. 25, 1986, abandoned.

[30] Foreign Application Priority Data

Jun. 5, 1986 [CA] Canada ..... 510956

[51] Int. Cl.[5] ..... A63H 5/00; G08B 21/00

[52] U.S. Cl. ..... 116/22 A; 119/29; 273/67 R; 446/402

[58] Field of Search ..... 116/22 A, 2, DIG. 44; 119/29; 273/84 R, 67 R; 231/21; 135/65, 66; 446/418, 419, 421, 422; 220/89 A

[56] References Cited

U.S. PATENT DOCUMENTS

| | | | |
|---|---|---|---|
| 113,061 | 3/1871 | Kast | 446/420 X |
| 236,234 | 1/1881 | Lee | 273/84 R |
| 441,042 | 11/1890 | Underwood et al. | 273/84 R |
| 765,605 | 7/1904 | Wade | 273/84 R |
| 1,986,682 | 1/1935 | Schulz | 273/84 R |
| 1,993,301 | 3/1935 | Tryon et al. | 220/89 A |
| 2,269,029 | 1/1942 | Lounsbery | 135/65 |
| 2,484,159 | 10/1949 | Flynn, Jr. | 446/422 |
| 2,839,242 | 6/1958 | Meistre, II | 231/2.1 |
| 3,087,728 | 4/1963 | Pond, III | 273/80 B |
| 3,172,393 | 3/1965 | Breland | 119/29 |
| 3,173,688 | 3/1965 | Green | 446/418 X |
| 3,206,205 | 9/1965 | McLoughlin | 273/80 B |
| 3,460,830 | 8/1969 | Barlow et al. | 446/419 |
| 3,498,266 | 3/1970 | Miller | 119/29 |
| 3,554,546 | 1/1971 | Brauhut | 231/2.1 X |
| 3,570,457 | 3/1971 | Curtis | 119/29 |
| 4,328,966 | 5/1982 | Miyamoto | 273/67 R |
| 4,690,404 | 9/1987 | Yoder | 446/418 X |
| 4,703,402 | 10/1987 | Hsieh | 362/102 |

*Primary Examiner*—Daniel M. Yasich

[57] ABSTRACT

A defensive baton is light in weight and can be carried without discomfort or inconvenience by a jogger or runner during physical exertion; the baton has a padded striking portion whereby no undue harm results from a blow by the baton; the baton has a rattle which emits sounds when moved; the baton has a frangible core, whereby no undue harm results from a blow by the baton; and the baton can be used to fend off or discourage atack by dogs and the like.

20 Claims, 1 Drawing Sheet

10
12
14
16
18
20
22
24
26
28
30
32
34
36
40
42
44
46
3

JOGGER'S NIGHTSTICK

This application is a continuation-in-part of application Ser. No. 911,600, filed Sept. 25, 1986, now abandoned.

BACKGROUND OF THE INVENTION

This invention relates to a defensive baton, more especially a defensive baton for use by joggers and runners to fend off attack by animals, for example, dogs.

Jogging and running are popular activities in North America. Many joggers and runners engage in this activity in city and suburban streets and other areas in which animals, such as dogs roam.

the sight of a jogger or runner moving quickly often incites animals, particularly dogs, to give chase and sometimes attack.

Joggers and runners are usually lightly clad and have no means of fending off such an attack.

Mail delivery personnel while on duty face similar problems even though they may be walking.

The present invention seeks to provide a baton which can be used by joggers, runners and the like to fend off or discourage attack.

The invention also seeks to provide such a baton, which is light in weight so that it can be readily carried during physical exertion.

Still further the invention seeks to provide such a baton which can be used to strike animals without unduly harming them, so as to discourage attack.

SUMMARY OF THE INVENTION

In accordance with the invention there is provided a defensive baton comprising an elongated, lightweight, hand-holdable body member having a soft padded defensive striking portion and having a sound producing means, such as a rattle.

In particular the padded striking portion has a thickness measured from its outer surface to its inner surface contacting the tubular body, which, in conjunction with the physical characteristics of the padding, particularly padding and resilience characteristics, protects an animal being struck, from the harder surface beneath the padding.

In a particular embodiment the baton comprises an elongated, tubular body having opposed first and second ends. A soft padding surrounds the tubular body and extends from the first end towards the second end, thus forming a soft padded defensive striking portion. A handle or gripping element spaced from the striking portion, remote from the first end, permits the baton to the securely grasped by wielding to fend off attack. The baton is of lightweight thereby facilitating hand carrying during physical exertion, for example, jogging or running.

It will be understood that the tubular body is of a relatively rigid material having a hard surface which would provide a damaging blow if not for the presence of the padding.

BRIEFR DESCRIPTION OF THE DRAWINGS

The invention is illustated in a particular and preferred embodiment by reference to the accompanying drawings in which.

DETAILED DESCRIPTION OF PREFERRED EMBODIMENT

Figures 1, 2, 3, 4:
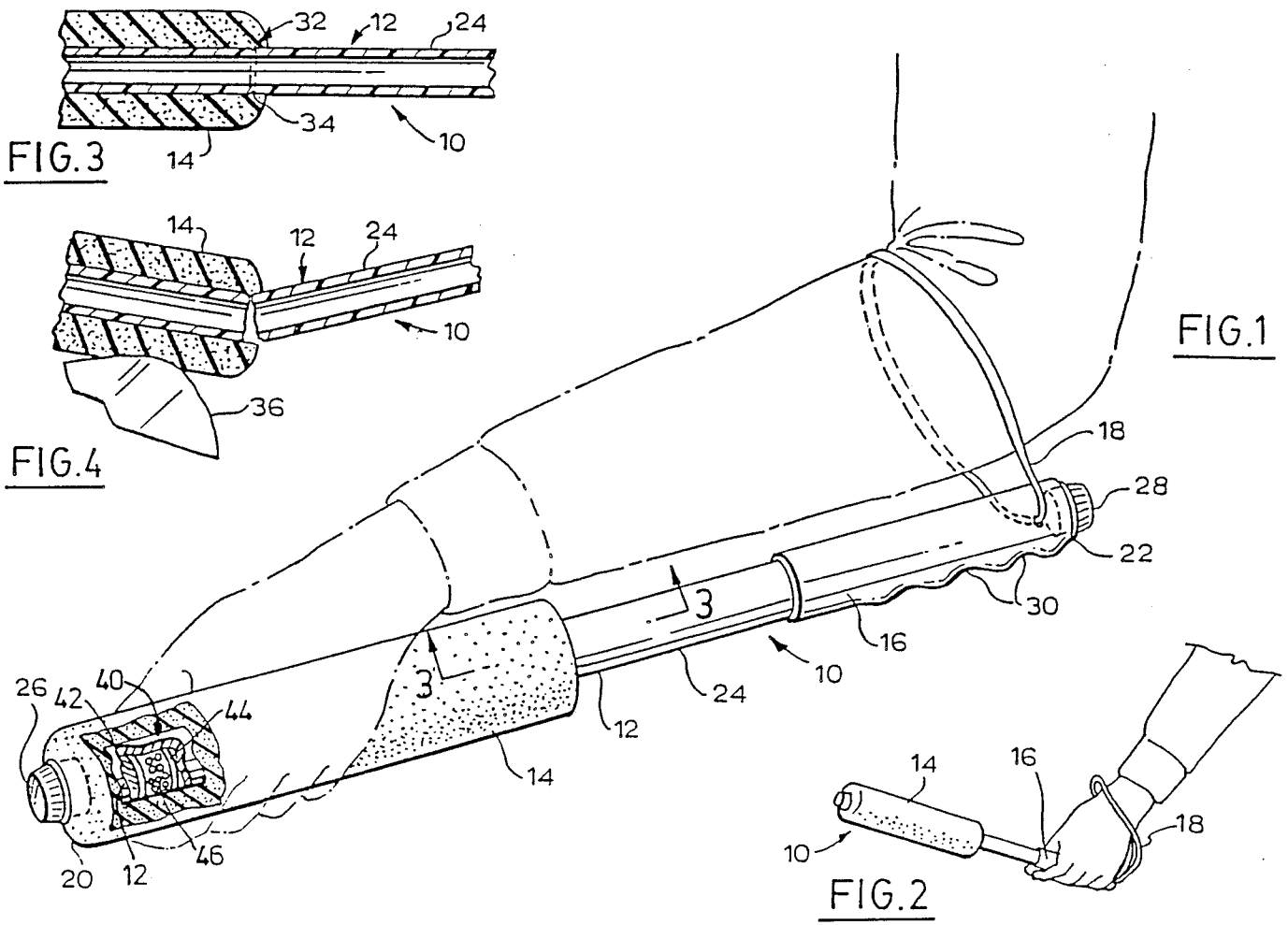
FIG. 1 shows schematically a defensive baton of the invention in the carrying configuration.
FIG. 2 shows schematically the baton of FIG. 1 in the wielding configuration.
FIG. 3 shows a detail, in cross-section on line 3—3 of FIG. 1, of the baton.
FIG. 4 shows a detail similar to FIG. 3 in a stress relief configuration during a blow to an animal.

With further reference to FIG. 1, a defensive baton 10 has a tubular body 12, a sleeve 14 of padding snugly surrounding body 12, a handle 16 and a strap 18.

Baton 10 includes a first end 20, a second end 22 and an intermediate portion 24. Sleeve 14 extends from first end 20 to one end of intermediate portion 24, and handle 16 extends from the other end of intermediate portion 24 to second end 22.

A green reflector 26 is mounted by any suitable means at first end 20 and a red reflector 28 is mounted by any suitable means at second end 22.

By way of example green reflector 28 may include a spigot surrounded by an annular flange, the spigot being snugly and tightly received in the bore of tubular body 12 at first end 20 so as to securely locate green reflector 26 at first end 20. Green reflector 26 may likewise be secured by adhesive material to first end 20.

Handle 16 includes finger channels 30 by means of which the handle 16 can be securely grasped as more particularly shown in FIG. 2.

With particular reference to FIG. 3, baton 10 includes a frangible portion 32 particularly formed by a groove 34 in tubular body 12 which reduces the wall thickness of body 12.

With particular reference to FIG. 4, frangible portion 32 breaks as a result of an excessive blow on an animal 36.

In the carrying configuration illustrated in FIG. 1, the baton 10 can be readily carried by a jogger or runner without inconvenience or discomfort. The carrying arm of the jogger or runner is threaded through the loop of strap 18 and the sleeve 14 is grasped in the carrying hand, adjacent first end 20. Thus in the usual body position for jogging or running, in which the arms are bent at the elbow, substantially to form a right angle between the upper arm and forearm, the baton 10 extends through the hand generally horizontal or parallel to the ground with the second end 22 disposed in the vicinity of the elbow. Baton 10 is light in weight and of dimensions such that it can be conveniently grasped by the hand about sleeve 14 or handle 16.

In the event of an attack or anticipated attack by an animal, the baton 10 is shifted to the wielding position illustrated in FIG. 2, this may be achieved by grasping first end 20 in the free hand and sliding the carrying arm through strap 18 away from first end 20 until the carrying hand grasps the handle 16 between finger channels 30. In this configuration illustrated in FIG. 2, the baton 10 can be wielded; baton 10 has a length such that the animal can be struck with padded sleeve 14 while the animal is still a safe distance from the body of the jogger or runner.

The sleeve 14 of padding which defines the striking portion of the baton 10 is soft and resilient so that should it become necessary to strike the animal, no damage to the animal is likely, although the blow will be sufficient to discourage the animal from attack.

As more particularly illustrated in FIGS. 3 and 4, in the event of an excessive strike or blow on the animal 36, the frangible portion 32 will rupture causing tubular body 12 to break, as particularly illustrated in FIG. 4, thereby relieving the stress of the blow on the animal 36.

The frangible portion 32 thus provides a safety factor ensuring that the baton 10 cannot be used as a weapon of aggression. Furthermore, frangible portion 32 provides for stress relief and ensures that serious harm cannot occur to the attacking animal in the event of a strongly directed blow by the runner or jogger.

The reflectors 26 and 28 serve to make the jogger or runner more visible in the event of nighttime activity. Fluroescent or luminescent colours may be applied to intermediate portion 24 in order to further enhance the visibility of the jogger or runner at night. These colours may, for example, be applied as a paint or tape.

The tubular body 12 is in particular of a rigid material having a relatively hard surface and suitably may be of a polymer material, for example, PVC or polyethylene or metal tubing, for example, aluminium; or other thin walled, light weight tubing of rigid, hard surfaced material may also be used. The groove 34 defining frangible portion 32 may be formed in tubular body 12 by a tube cutter or the like.

The sleeve 14 may be of foam, sponge, rubber or similar soft and resilient padding material and it will be understood that the sleeve 14 should have a thickness sufficient to protect an animal being struck from the harder surface of the tubular body 12.

With reference to FIG. 1, there is a rattle 40 dispósed within tubular body 12. Rattle 40 is formed by disc walls 42 and 44 rigidly spaced apart within body 12, to define a chamber enclosing a pluarlity of small bearings 46. In operation, rattle 40 emits a rattling sound and serves to confuse and scare off animals. Different sounds may be produced by modifying the characteristics of walls 42 and 44 and bearings 46.

Thus the present invention provides a light weight baton 10 which can be readily carried by a jogger or runner without discomfort or inconvenience during the physical exertion of jogging or running, and which can be readily adjusted from a carrying configuration to a defensive wielding configuration to ward or fend off attack from animals, such as dogs.

What I claim as my invention is:

1. A baton comprising an elongate, tubular body having (a) opposed first and second ends, (b) a striking portion terminating at said first end, (c) a soft padding surrounding said striking portion and extending towards said second end and (d) sound producing means for producing a sound, said sound producing means having one part which moves relative to said body in response to the movement of the baton.

2. A baton according to claim 1, wherein said body includes a frangible portion adapted to rupture under excessive impact.

3. A baton according to claim 2 wherein said sound producing means is a rattle.

4. A baton according to claim 2, wherein said soft padding is a sleeve of soft resilient material snugly surrounding said body and wherein said frangible portion is concealed by said sleeve.

5. A baton according to claim 4 wherein said sound producing means is a rattle.

6. A baton according to claim 4, wherein said body is of a rigid material having a hard surface, and said sleeve has resilience characteristics effective to protect an animal being struck by said hard surface.

7. A baton according to claim 6 wherein said sound producing means is a rattle.

8. A baton according to claim 1 wherein said sound producing means is a rattle.

9. A baton comprising:

an elongate, tubular body having opposed first and second ends, a soft padding surrounding said tubular body and extending from said first end towards said second end to form a soft padded defensive striking portion, holding means spaced from said striking portion, remote from said first end, sound producing means, moveably located in said body, for producing sound when the baton is moved, and and said body having a frangible portion adapted to rupture under excessive impact.

10. A baton according to claim 9, wherein said frangible portion is concealed by said padding.

11. A baton according to claim 10 and further including light reflectors on said opposed first and second ends and a carrying strap adjacent said second end.

12. A baton according to claim 11 wherein said sound producing means is a rattle.

13. A baton according to claim 10 wherein said sound producing means is a rattle.

14. A baton according to claim 10, wherein said tubular body is of rigid material having a hard surface, said soft padding having a thickness and physical characteristics effectived to protect an animal being struck from damage by said hard surface.

15. A baton according to claim 14 wherein said sound producing means is a rattle.

16. A baton according to claim 9 and further including light reflectors on said opposed firfst and second ends and a carrying strap adjacent said second end.

17. A baton according to claim 16 wherein said sound producing means is a rattle.

18. A baton accoridng to claim 9. wherein said sound producing means is a rattle.

19. A baton according to claim 9, wherein said tubular body is of rigid material having a hard surface, said soft padding having a thickness and physical characteristics effective to protect an animal being struck from damage by said hard surfaces.

20. A baton according to claim 19 wherein said sound producing means is a rattle.

* * * * *